United States Patent [19]

Reeves

[11] 4,335,992

[45] Jun. 22, 1982

[54] SIDE SHIFT FORK ADJUSTABLE CARRIAGE

[75] Inventor: Jerry L. Reeves, Dallas, Oreg.

[73] Assignee: Towmotor Corporation, Mentor, Ohio

[21] Appl. No.: 130,487

[22] PCT Filed: Jan. 7, 1980

[86] PCT No.: PCT/US80/00015

§ 371 Date: Jan. 7, 1980

§ 102(e) Date: Jan. 7, 1980

[87] PCT Pub. No.: WO81/02001

PCT Pub. Date: Jul. 23, 1981

[51] Int. Cl.[3] ..... B66F 9/14

[52] U.S. Cl. ..... 414/667

[58] Field of Search ..... 414/621, 667, 671

[56] References Cited

U.S. PATENT DOCUMENTS

| | | | |
|---|---|---|---|
| 2,613,830 | 10/1952 | Ponnequin | 414/621 |
| 2,795,346 | 6/1957 | Farmer | 414/621 X |
| 2,958,436 | 11/1960 | Skutle | 414/621 |
| 3,166,207 | 1/1965 | Quayle | 414/621 |
| 3,181,430 | 5/1965 | Freedy et al. . | |
| 3,184,088 | 5/1965 | Berge | 414/621 |
| 4,086,843 | 5/1978 | Lorimor | 91/413 |
| 4,185,944 | 1/1980 | Seaberg | 414/621 |

FOREIGN PATENT DOCUMENTS 2726147 12/1978 Fed. Rep. of Germany .

*Primary Examiner*—Robert G. Sheridan

*Attorney, Agent, or Firm*—Phillips, Moore, Weissenberger, Lempio & Majestic

[57] ABSTRACT

A material handling device such as a lift truck (10) includes a pair of material handling forks (16,18) mounted on a carriage (22) that is movable upwardly and downwardly on a mast (14) by a hydraulic lift cylinder (104). The material handling forks (16,18), which are usable to pick up, transport, and deposit articles, must be positioned properly under the article. A hydraulic system (102) is included with tracks (22,24) mounted on the carriage (20) to permit selective transverse movement of the forks (16,18) on the carriage (20) from an abutting position to a fully extended position. The hydraulic circuit (102) is pressure responsive to the pressure in the lift cylinder (104).

16 Claims, 7 Drawing Figures

SIDE SHIFT FORK ADJUSTABLE CARRIAGE

DESCRIPTION

1. Technical Field

This invention relates generally to material handling equipment and more particularly to fork lift vehicles. Specifically it deals with side shifting of the material handling forks and the associated hydraulic circuitry for operation of the side shifting arrangement.

2. Background Art

Material handling vehicles, such as fork lifts, in order to be useful, should have a certain degree of adjustability. This is particularly true if the vehicle is to be used to handle differing types of loads. It is also true in a material handling vehicle which handles similar loads, but in a different operating environment. For example, as the vehicle approaches the load to be handled, it is usual for the vehicle to approach the load at differing aspects. Even though these differing aspects may be of a minor amount, the load handling equipment, such as forks in the case of a fork lift, may not properly align with the load. When this occurs it requires a certain degree of maneuvering of the vehicle in order to obtain alignment of the load handling elements forks and the load.

After maneuvering to pick up the load and subsequent to picking up the load, the vehicle is ordinarily driven to the off-loading point. The same maneuvering of the vehicle at the off-loading point that occurred at the loading point may also be necessary. That is, the vehicle may not be aligned with the loading dock, truck, or the like and thus the material handling vehicle must maneuver in order to position the load properly.

In providing a capability to shift the load handling elements laterally relative to the vehicle, it is important not to degrade forward visibility from the operators station. It is equally important to reduce the offset of the load, from the vehicle center of gravity, referred as load moment offset. Other desiderata include reduction of the number of hydraulic lines, closer spacing of the forks, and providing an operating system for the load handling elements that is sensitive to the load carried.

Various solutions to these problems have been developed for material handling vehicles. Specifically side shifting forks to handle varying widths of loads are available. In a related field, that is in a vehicle that incorporates a pair of load clamps rather than forks, side shifting of the load has been provided along with the clamping feature. Such side shifting of the load in a clamping type vehicle permits pick up and subsequent placement of the load at a more specific location than would be readily available through maneuvering of the vehicle as discussed above. In the past the side shifting mechanism along with the necessary track structure to support the forks or clamps has degraded forward visibility because of the relatively massive track structure and further has required extensive hydraulic plumbing.

In other solutions the carriage upon which the forks are mounted has been designed to shift sideways in order to adjust or position the forks to pick up or deposit a load. Individual spacing of the forks upon such a side shift carriage may be accomplished manually or with additional hydraulic structure. In an arrangement such as the sideshift carriage wih hydraulically adjustable forks, the additional structure required to move the forks and carriage increases the load moment offset from the center of gravity of the vehicle by moving the forks further from the center of gravity. This, of course, reduces the load carrying capacity of the vehicle. Accordingly, reduction of the structure necessary to side shift the load, thus reducing the load moment offset, is advantageous. The reduction of the load moment offset by elimination of the structure to shift the carriage and concentration of the side shift capability in the forks alone also reduces weight of the overall attachment. It should be readily apparent that reduction of the overall weight and reduction of the load moment offset permits an increase in the load carrying capacity of the vehicle itself.

Individual fork adjustment may also be appropriate when it is necessary to pick up a load with a center of gravity laterally offset from the center line of the vehicle. One fork may then be moved laterally across the face of the carriage in order to compensate for the offset center of gravity of the load. Once the load is picked up both forks and thus the load may be moved in the opposite direction to shift the center of gravity of the load to a point coincident with the center line of the vehicle thus eliminating or reducing the possibility of overturning the vehicle.

Side shifting of either the carriage or of the forks in previous vehicles has usually been accomplished by a separate hydraulic circuit which shifts the carriage or the forks at a constant pressure. Providing sufficient pressure and flow to the hydraulic cylinders to move a fully loaded carriage or pair of forks has been the aim of these earlier structures. It is equally likely the forks or carriage will be shifted with no load. With the high pressure and flow provided in available fork or carriage shift mechanisms the shift feature when operated without a load has resulted in a rather abrupt and sometimes rather startingly rapid shift of the forks or carriage.

When a material handling vehicle such as a fork lift or the like operates in an environment having numerous obstructions, the forks may inadvertantly contact an obstruction while the vehicle is turning, thereby placing an undesirable side load on the fork. Such a load may result in damage to either the fork, the carriage, or in the event of a hydraulically operated side shift arrangement to the hydraulic circuitry. Damage which does occur as a result of contacting obstruction may result in loss of the use of the vehicle for that period of time necessary to repair it.

Finally, in those vehicles in which a side shift capability has been provided to the forks, the forks have been operable on a track structure with a runner or the like to locate the forks on a track structure. The nature of the structure is usually such that the forks may not be placed in an abutting relation, thus the total side shift of the individual forks may be reduced by the separation of the forks at their closest position.

The present invention is directed to overcoming one or more of the problems as set forth above.

DISCLOSURE OF THE INVENTION

In one aspect of the present invention, a material handling vehicle has a mast with a carriage assembly connected thereto for vertical movement thereupon. First and second load lifting forks are included with the material handling vehicle. The improvement comprises a track assembly for movably connecting the forks to the carriage assembly for movement of the forks between a first position so that the sides of each fork are in contact one with another. The forks may be moved to a second position at which their respective sides are spaced one from another. The track assembly includes a first pair of tracks having first and second spaced-apart tracks each connected to the carriage assembly in a generally horizontally plane generally perpendicular to the vertical movement of the carriage assembly. First and second sliding bars, each having inner end portions, are connected respectively to each fork and are slidably connected to a respective track, with the forks being substantially perpendicular relative to the tracks. The sliding bars each have a length sufficient for maintaining the forks substantially perpendicular to the track with the tracks being positioned relative one to the other at locations sufficient for overlapping the inner end portions of the sliding bars at the first position of the forks.

In this invention, the problem of side shifting of a load on a material handling vehicle such as a fork lift, which in the past had required rather extensive structure that degraded forward visibility, has been solved by overlapping tracks thereby increasing the forward visibility while concurrently reducing the load moment offset and weight of the fork and carriage structure. Furthermore, hydraulic circuitry is provided that conditions the side shift pressure to be proportional to the load on the forks, thereby eliminating excessive pressures in the sideshift mechanism.

BEST MODE FOR CARRYING OUT THE INVENTION

Figure 1:
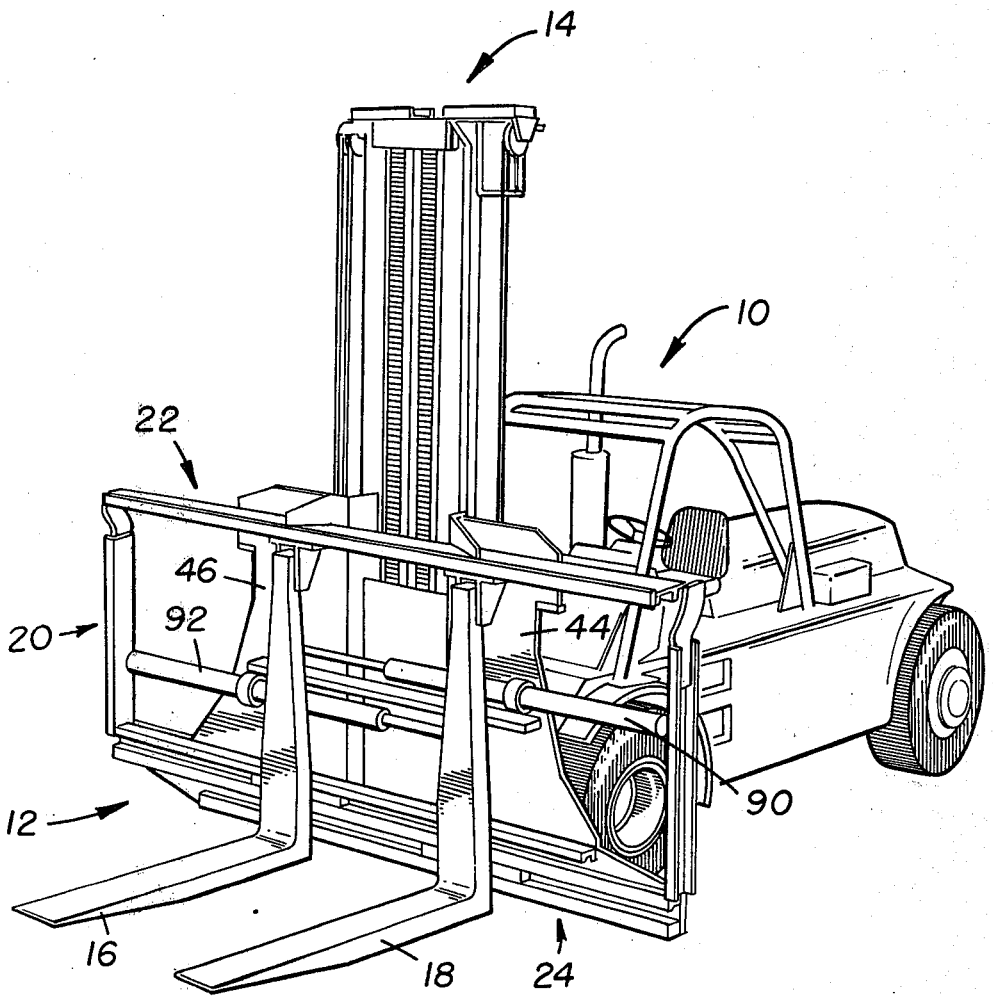
FIG. 1 is a diagrammatic perspective view of a fork lift incorporating side shifting forks which form an embodiment of the present invention.

A material handling vehicle such as a lift truck 10 is shown in FIG. 1 having mounted thereupon a side shift fork adjustable carriage 12. Lift truck 10 includes a mast assembly 14 at one end thereof to which the adjustable carriage 12 is affixed for vertical movement. Adjustable carriage 12 has fitted thereon a pair of forks 16 and 18 (see FIG. 2) which are adapted to receive a load. Operation of the lift truck 10 is well known in the art and will not be further described other than to state that loads received on forks 16 and 18 may be lifted free of the ground for transport and placement at some position remote from the point of pick up. Since the size and center of gravity of the load to be picked up may vary, the forks must be positioned properly under the load to avoid losing the load during the transport and placement operation. Placement of the forks may be accomplished in one of two manners, either by maneuvering the vehicle or by sideways adjustment of the forks after a gross positioning of the vehicle.

The Mechanical System

Figure 5:
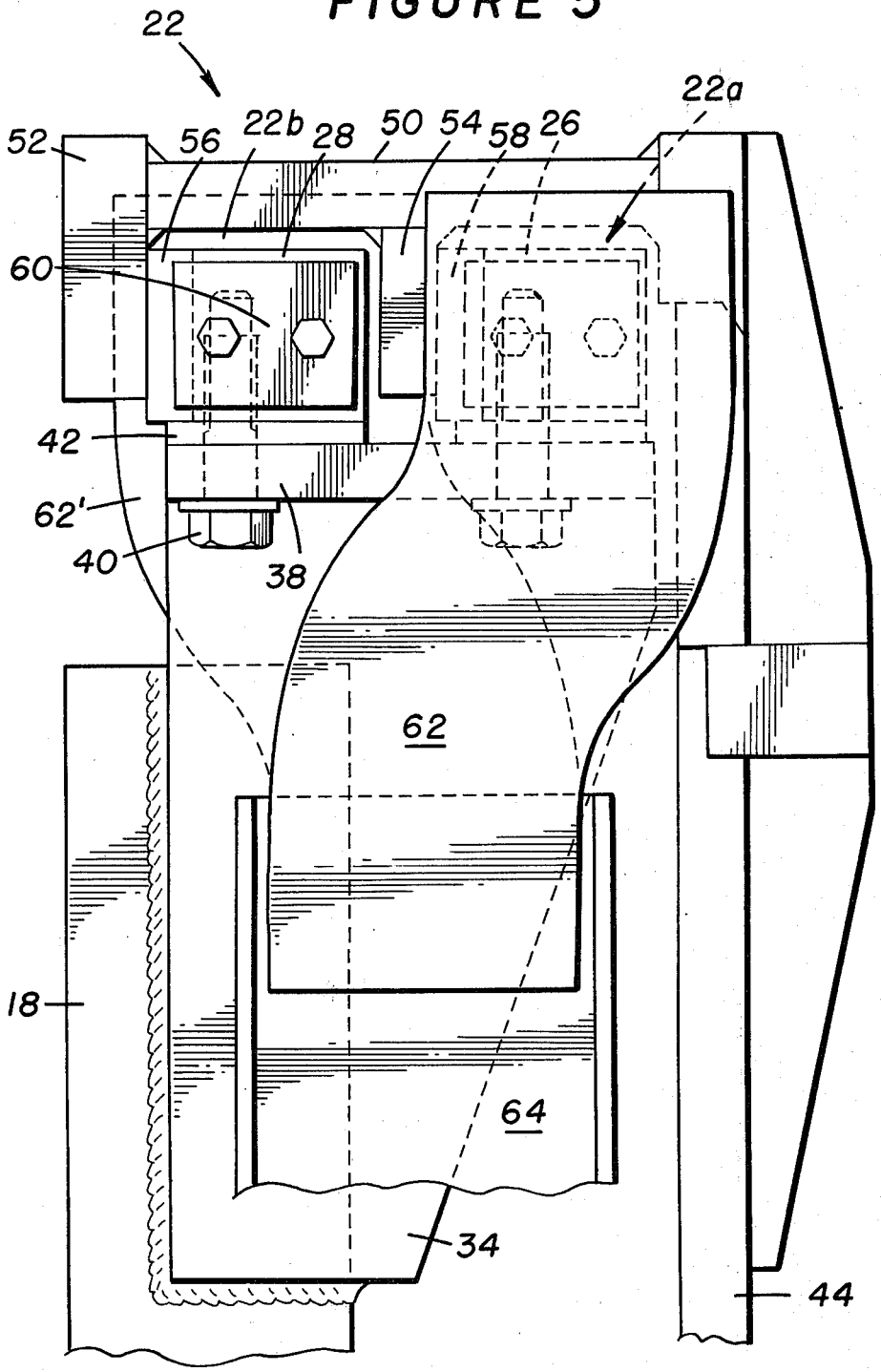
FIG. 5 is a diagrammatic detailed view taken at section line IV—IV of FIG. 2.
Figure 6:
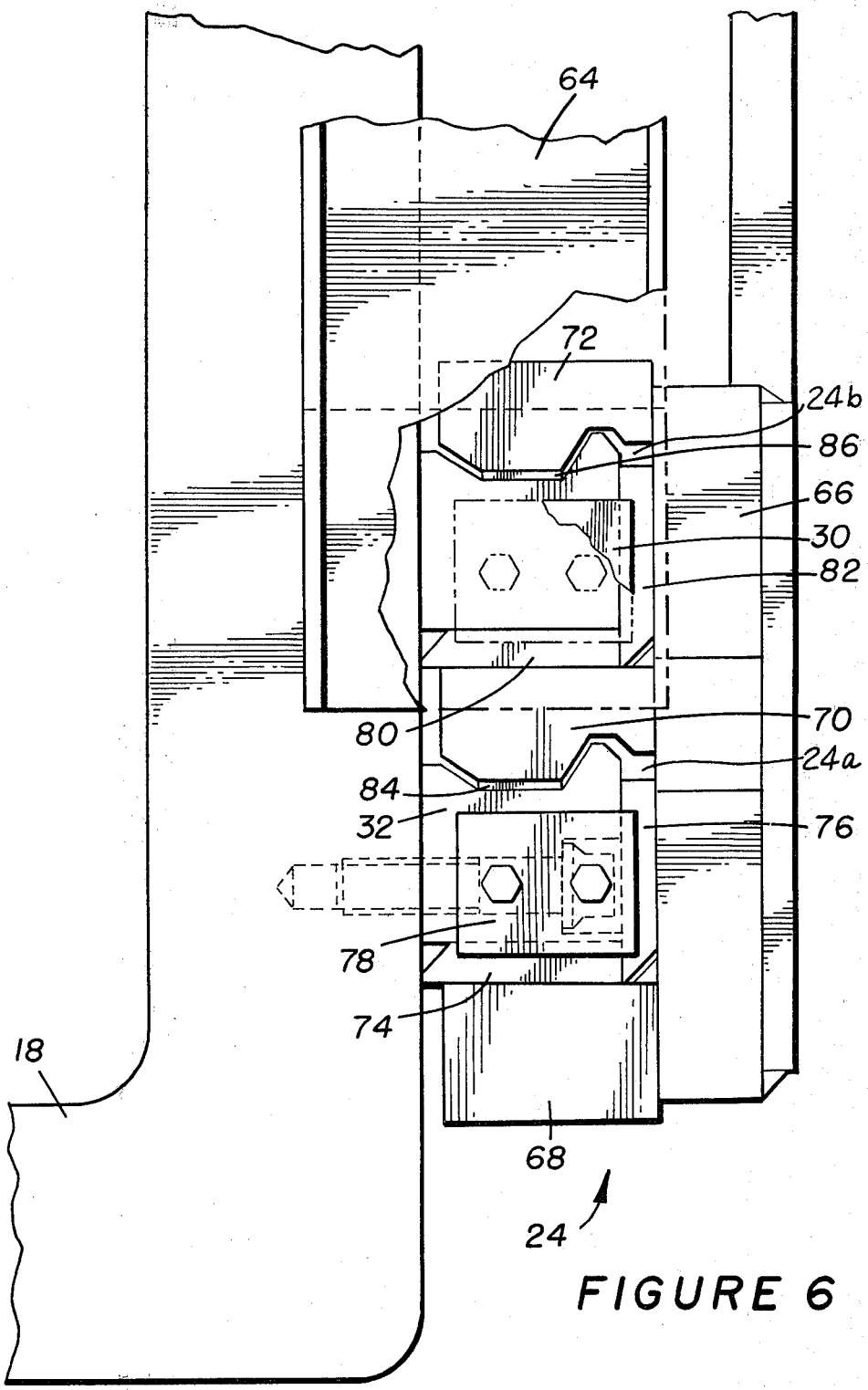
FIG. 6 is a diagrammatic detailed view partly in section taken at section line V—V of FIG. 2.

Forks 16 and 18 are mounted for horizontal movement upon the carriage portion 20 of the side shift adjustable carriage 12. Such movement is facilitated by two pairs of tracks, the first pair of tracks 22, comprised of individual tracks **22*a* and 22*b*, located adjacent the top edge of the carriage portion 20 and a second pair of tracks 24, comprised of individual tracks 24*a* and 24*b*, located adjacent the bottom edge of the carriage 20. One pair of these tracks, preferably the first pair 22 located along the top edge of carriage 20 is oriented in a horizontal plane as illustrated in FIG. 5 while the second pair of tracks, preferably the lower pair 24, is oriented in a vertical plane as illustrated in FIG. 6. It should be understood that both pairs could be located in either the horizontal or vertical plane, however, the positioning of the first pair of tracks 22 at the upper edge in the horizontal plane provides greater visibility through the carriage 20 from the operator station of the lift truck. Furthermore, positioning the second pair of tracks 24 in the vertical plane as illustrated in FIG. 6 reduces the weight requirements of the carriage since the vertical load placed on the forks is carried primarily by the lower set of tracks. To position the lower set of tracks in a horizontal plane would require additional strength members not necessary with the vertical arrangement as illustrated in FIG. 6**.

Each fork 16 or 18 is associated with one of the tracks of the first pair of tracks 22 by an elongated bearing bar 26 or 28 having a length L and as inner end portion **26*a* or 28*a*, respectively, and one of the tracks of the second pair of tracks 24 by an elongated bearing bar 30 or 32 having a length L′ and an inner end portion 30*a* or 32*a*, respectively. Fork 18, as shown in FIG. 5, has affixed at its upper end a pair of generally triangular shaped plates 34 and 36 (see also FIG. 2) which are connected at their upper end to a horizontal plate 38, for example, by welding. Bearing bar 28 is affixed to plate 38 by means such as bolts 40. A shim or spacer 42 may be appropriately affixed between plate 38 and bearing bar 28. The bearing bars, as will be seen, permit sliding movement of the forks in the tracks while the length L provides more positive guidance, increased stability, while maintaining the forks substantially perpendicular relative the tracks. The particular arrangement of the tracks, that is, the horizontal plane orientation of the first pair of tracks 22 and the vertical plane orientation of the second pair of tracks 24, permit the forks 16 and 18 to achieve the abutting relationship shown in FIG. 2. The abutting relationship, which permits a greater horizontal movement of the pair of forks than is ordinarily found in side shift fork assemblies that utilize the single track arrangement, is accomplished in spite of the fact of the elongated bearing bars 26 and 28 affixed at the upper ends of forks 16 and 18 and elongated bearing bars 30 and 32 affixed at the lower ends of forks 16 and 18** by permitting the inner end portions of the respective bars to overlap in their respective pairs of tracks.

Referring now to FIG. 5, the structure of bearing bar 28 will be described in relationship with fork 18. It should be understood that the forks are symmetrical, thus permitting utilization of substantially identical parts with either fork. It should further be noted that certain parts associated with the forks are utilized at either end; however, the part may be reversed when associated with the fork at the opposite end. When such an instance occurs this will be noted.

Carriage portion 20 is formed with a pair of center members 44 and 46 on which carriage rollers 48 are mounted. As is usual in the lift truck art, carriage rollers 48 roll on mast 14 for vertical movement of a carriage and fork assembly. Affixed to the upper ends of center members 44 and 46 by gusset means or the like, is a plate 50 which extends laterally across the face of the carriage forming the upper edge thereof. A front bearing plate 52 is affixed to plate 50 and extends downwardly therefrom as indicated in FIG. 5. A rear bearing plate 54 is also affixed at plate 50 and extends downwardly generally at the center point or thereof. Front bearing plate 52 and rear bearing plate 54 form the bearing surfaces upon which bearing bars 28 and 26 respectively ride.

Interposed between bearing bar 28 and front bearing plate 52 and associated with bearing bar 28 is a bearing block 56 made of a plastic material such as ultra high molecular weight polyethylene. This material which is utilized in other portions of this invention will hereinafter be referred to as UHMW bearing material. A similar bearing block 58 also made of UHMW bearing material is disposed between bearing bar 26 and rear bearing plate 54. It should be apparent to those skilled in the art that the load moment generated by forks 16 and 18 is generally directed in a horizontal direction as indicated in FIG. 5 against the front and rear bearing plates 52 and 54 respectively. Thus the bearing blocks 56 and 58 serve to permit movement of the bearing bars 28 and 26 and the associated forks 18 and 16 laterally across the face of the carriage. As can be seen in FIG. 5, a plate 60 is affixed at the end of bearing bar 28 thus effectively locking bearing block 56 into a fixed position in relation to bearing bar 28. A similar plate 60' is located at the opposite end of bearing bar 28. Thus sliding movement of bearing bar 28 laterally across the face of carriage 20 carries with it the bearing block 56 which in turn slides against front bearing plate 52. A similar arrangement is provided to retain bearing block 58 in a fixed relationship with bearing block bar 26.

Figure 2:
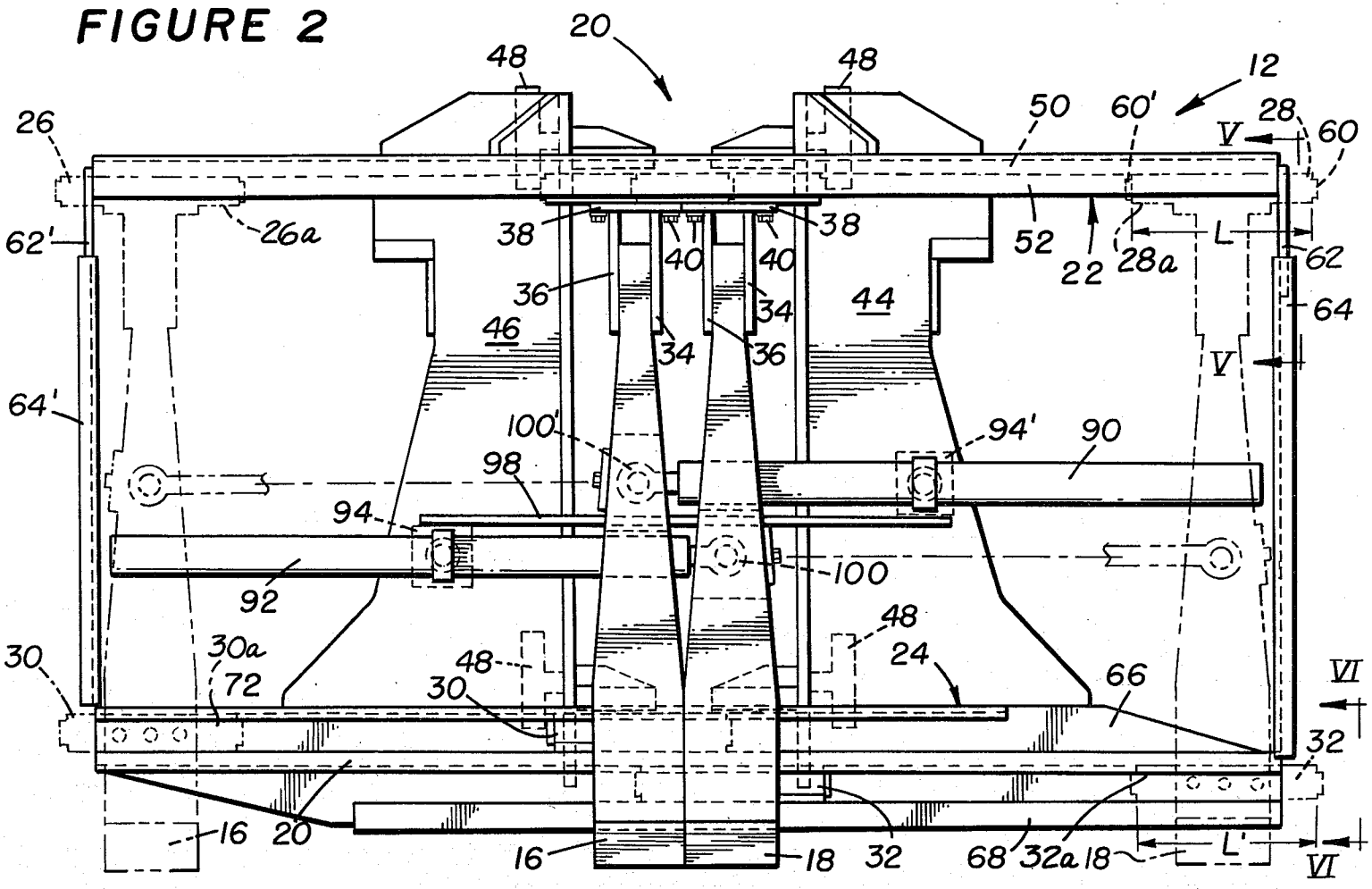
FIG. 2 is a diagrammatic front elevational view of the side adjusting forks shown in FIG. 1.

Referring to FIG. 5, front bearing plate 52 and rear bearing plate 54 form the first pair of tracks 22, specifically track **22*a* being the rear track and track 22*b* being the front track. Referring to FIG. 2, it should be noted that the bearing bars 26 and 28 are permitted to extend outwardly at the end of these tracks. However, the right end of track 22*a* (the rear track) as shown in FIG. 5 is shown covered by a curved plate member 62 affixed to a vertical member 64, which forms a right side of the carriage. The curved plate 62 may be used at the opposite or left hand of the carriage shown in FIG. 2 if the plate is reversed as previously indicated. This is shown as curved plate 62' in FIGS. 2 and 4. Curved plate 62' closes the left hand of track 22*b*** and permits the bearing bar to extend outwardly off the track.

Referring again to FIG. 2, a bottom plate member 66 is affixed to center members 44 and 46 respectively and extends outwardly to the full extreme of the carriage. Bottom plate member 66 has affixed along its bottom edge a lower track 68 which forms one of the second pair of tracks 24. Generally at the midpoint of bottom plate member 66 is a second track member 70 oriented generally above the bottom track 68. A third member 72 is affixed along the top of bottom plate member 66 extending in the same manner as bottom track 68 and second track 70. More will be said about this upper member 72.

Bearing bar 32 is affixed to fork 18 by bolts or the like as indicated in FIG. 6. Similarly bearing bar 30 is affixed to fork 16 for movement therewith. Disposed between bearing bar 32 and bottom track 68 is a bearing block 74, preferably of UHMW material, that is retained therewith along with a second bearing block 76 also of UHMW material by a plate 78 as indicated in FIG. 6. A similar plate would be affixed at the opposite end of bearing bar 32. Similarly, a bearing block 80 also of UHMW material is disposed between bearing bar 30 and second track 70 along with a UHMW bearing block 82 interposed between bearing bar 30 and plate 66. A plate similar to plate 78 would be positioned at each end of bearing bar 30 to retain the bearing blocks 80 and 82 respectively adjacent the bearing bars upon lateral movement of the forks 16 and 18 across the face of carriage 20.

Second track 70 as indicated in FIG. 6 has a downwardly extending portion having a generally frusto-conical cross-section as indicated in FIG. 6. This generally frusto-conical cross-section is repeated in bearing bar 32 which acts in cooperation with second track 70 to retain fork 18 adjacent carriage 20. It is appropriate to position a bearing member 84 between bearing bar 30 and second track 70 to reduce wear therebetween. A similar shape is formed in the lower portion of upper member 72 as indicated in FIG. 6 along with a corresponding shape in bearing bar 30. A bearing member 86, which may be bronze or the like, may be positioned between bearing bar 30 and upper member 72 as indicated in FIG. 6.

Referring to FIG. 2, it can be seen that vertical member 64 extends downwardly and is affixed to plate 66. Similarly, at the opposite end a similar vertical 64' extends downwardly and is affixed at that end to plate 66.

The Hydraulic System

Forks 16 and 18 are moved laterally across the face of carriage 20 by a pair of hydraulic jacks 90 and 92 respectively. Since both of these jacks are the same, reference will first be made to FIG. 4 wherein jack 92 is shown affixed to fork 18. It should be noted that jack 90 is affixed in a similar manner to fork 16, however, the positions will be reversed. Jack 92 is affixed to center member 46 on a trunnion mount 94 which allows limited rotation about a bearing 96 (see FIG. 4). The rod end of jack 92 is affixed by an eye 100 to a fork 18. Similarly, eye 100' of jack 90 affixes jack 90 to fork 16.

Figure 7:
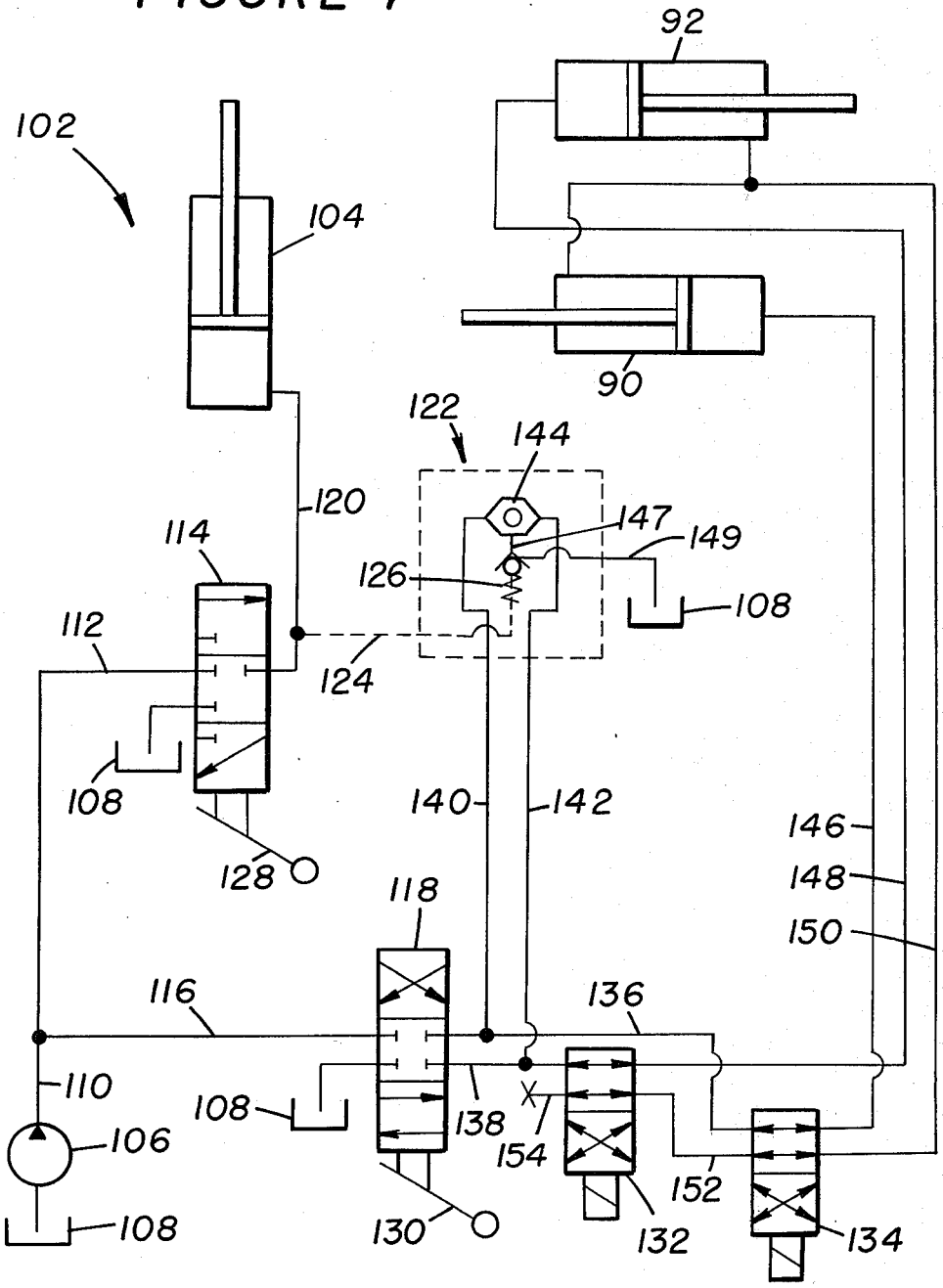
FIG. 7 is a schematic diagram of the hydraulic control circuit for the side shifting fork arrangement.

Referring now to FIG. 7, the schematic of a hydraulic circuit 102 capable of operating the aforedescribed system is shown. A novel feature of this hydraulic circuit is the reduction in the number of hydraulic lines provided to the carriage in order to operate the side shift arrangement of the forks. This will become apparent in the ensuing description. Hydraulic circuit 102 in addition to jacks 90 and 92 includes a third jack 104 which is operable to raise and lower the carriage 20 on mast 14.

Hydraulic fluid under pressure is provided by a pump 106 drawing fluid from a tank 108. Fluid is provided from pump 106 to a conduit 110 which branches into a conduit 112 leading to a lift valve 114 and a conduit 116 leading to a side shift valve 118.

Lift valve 114 is a three-position three-way valve having a normally closed center position and operated by a cane 128. A conduit 120 from lift valve 114 leads leading to the head end of lift cylinder. With the valve in the position shown in FIG. 7, no fluid is passed through lift valve 114; therefore, the lift jack 104 will remain in the position last set. A pressure sensing relief valve 122 is controlled by pressure in conduit 120 through a pilot line 124. The purpose of pressure sensing relief valve will become apparent in the ensuing discussion; therefore, suffice it to say that pilot line 124 acts on a spring biased check valve 126 to relieve pressure in jacks 90 or 92 as appropriate.

Figure 4:
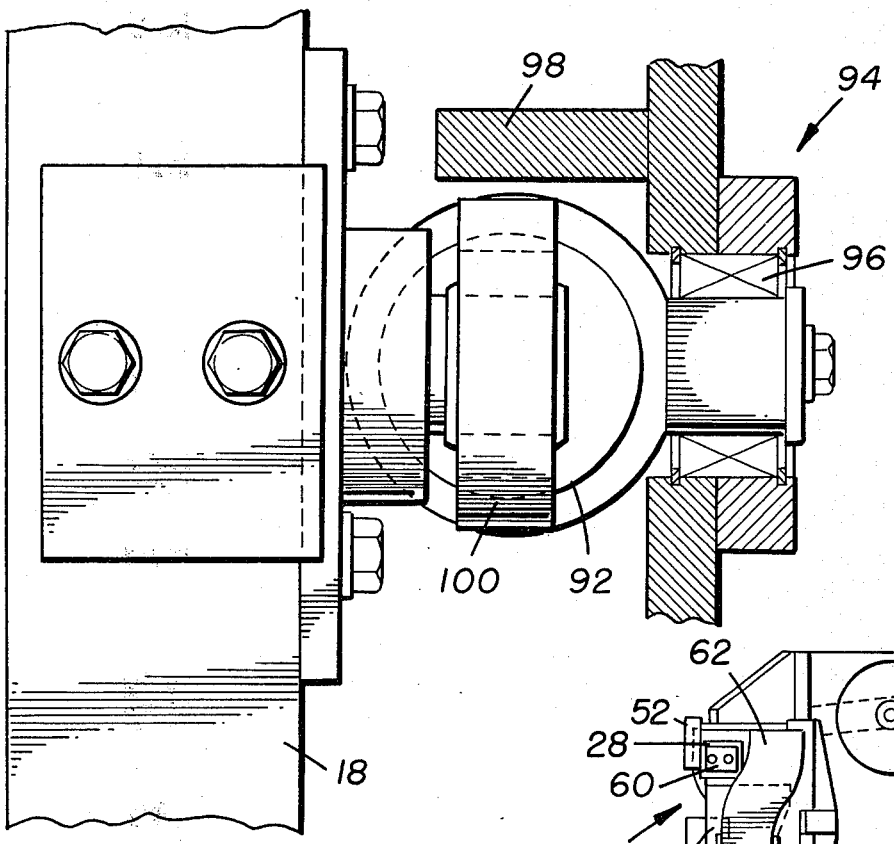
FIG. 4 is a diagrammatic detail of the trunnion mounting of the power structure for the fork lift arrangement.
Figure 3:
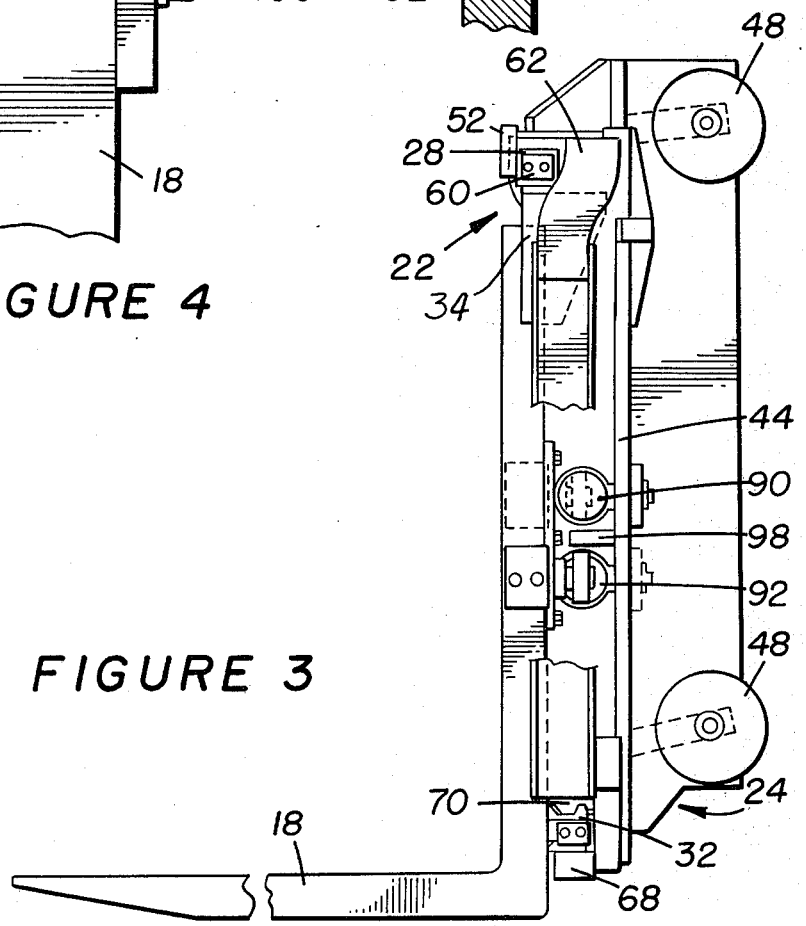
FIG. 3 is a diagrammatic side elevational view partly in section of the fork lift structure depicted in FIG. 2.

Shift valve 118 is preferably a four-way three-position valve as shown in FIG. 4, operable by a cane 130 to provide pressure to jacks 90 and 92 thereby shifting forks 16 and 18 leftwardly or rightwardly as the case may be. Interposed between shift valve 118 are a pair of two-position four-way valves 132 and 134 that, when used in conjunction with shift valve 118, serve to move the individual forks 16 or 18 either rightwardly or leftwardly as the case may be. This will become more apparent in the discussion of the operation of this system.

Valve 118 feeds a pair of conduits 136 and 138, each of which feeds a branch conduit 140 and 142, respectively, leading to a double check valve 144 with a lead 147 to spring biased check valve 126. Normally closed check valve 126 blocks communication of lead 147 to a conduit 149 which communicates with tank 108.

Conduit 136 leads to valve 134 while conduit 138 leads to valve 132. With valve 134 in a straight through position, conduit 136 is interconnected with a conduit 146 leading to the head end of jack 90. With valve 132 and valve 134 in the straight through position as shown in FIG. 7, conduit 138 leads to a conduit 148 which leads to the head end of jack 92. A third conduit 150 branches to the rod ends of both jacks 90 and 92.

Industrial Applicability

In operation the forks 16 and 18 are adjustable on the carriage 20 with the carriage in any position on the mast. Further, the forks 16 and 18 may be adjusted with any load thereupon. Specifically, forks 16 and 18 may be positioned as closely as shown in FIG. 2, that is in an abutting relationship, or as a widely separated as shown in phantom in FIG. 2, specifically at the extreme edges of the carriage. The forks are individually operable or operable together to move either to the left or to the right. Operation of the forks is accomplished by manipulation of side shift valve 118 in conjunction with valves 132 and 134. The following table illustrates the resulting action on jack 90 and jack 92 indicating the direction to the right or left as shown in FIG. 7.

| Valve 118 | Valve 132 | Valve 134 | Jack 90 Moves | Jack 92 Moves |
|---|---|---|---|---|
| straight | straight | straight | left | left |
| straight | cross | straight | left | — |
| straight | straight | cross | — | left |
| straight | cross | cross | right | — |
| cross | straight | straight | right | right |
| cross | cross | straight | right | — |
| cross | straight | cross | — | right |
| cross | cross | cross | left | — |

It should be noted that operation of jack 90 and 92 is accomplished from pressure provided by pump 106 that also provides pressure to lift jack 104. As previously noted, pilot line 124 biases spring bias check valve 126. Concurrently, pressure supplied to jacks 90 and 92 may be relieved through double check valve 144 should the pressure in either conduit 140 or 142 exceed that of the bias of spring bias check valve 126. Should this occur, pressure is bled off from conduit 140 or 142 and is returned to sump 108 via line 108. The pressure sensitive relief valve 122 offers one additional feature not found elsewhere. Should the operator inadvertantly hit an obstruction with one of the forks 16 or 18 while turning, the lateral force imposed thereupon would be transmitted back to either jack 90 or 92. With the pressure sensing relief valve 122, the sudden pressure spike resulting from the impact of one of the forks against an obstruction is relieved through double check valve 144 and spring bias check valve 126. This saves considerable wear and tear on the machinery and prevents inadvertant damage to not only the mechanical parts but also the hydraulic parts. Equally important is the fact that pressure supplied to the jacks 90 and 92 is dependent upon the load carried by the lift jack 104. Thus, the motion of forks 16 and 18 during their lateral movement across the carriage should be relatively constant no matter what the load may be on the forks.

Other aspects, objects and advantages of this invention can be obtained from a study of the drawings, the disclosure, and the appended claims.

I claim:

1. In a material handling vehicle (10) having a mast (14), a carriage assembly (12) connected to the mast (14) for vertical movement thereupon and first and second load lifting forks (16,18) each having a side, the improvement comprising:

track means (22,24) for movably connecting said forks (16,18) to the carriage assembly (12) for movement of the forks (16,18) between a first position at which respective sides of each fork are in contact with one another and a second position at which the respective sides of each fork (16,18) are spaced one from the other, said track means (22,24) including a first (22) pair of tracks having first **(22*a*) and second (22*b*) spaced apart tracks each connected to the carriage assembly (12) in a generally horizontal plane, said horizontal plane generally perpendicular to the vertical movement of the carriage assembly (12) and first (26) and second (28) sliding bars each having inner end portions (26*a*,28*a*) and being connected to a respective fork (16 or 18) and slidably connected to a respective track (22*a* or 22*b*), said forks (16,18) being oriented substantially perpendicularly relative to the tracks (22*a*,22*b*) and said sliding bars (26,28) each having a length (L) sufficient for maintaining said forks (16,18) substantially perpendicular relative to the track (22*a* or 22*b*) and said tracks being positioned one relative to the other at locations sufficient for overlapping of the inner end portions of sliding bars at the first position of the forks (16,18)**.

2. The material handling vehicle of claim 1 wherein the track means (22,24) includes a second pair of tracks (24) affixed to said carriage assembly (12), the improvement further including a second pair (30,32) of sliding bars, one of said bars (30,32) being positioned to slide in one of said second pair of tracks (24) and the other of said bars being positioned to slide in the other of said tracks, each of said forks (16,18) being connected respective to one or the other of said second pair of sliding bars (30,32).

3. The material handling vehicle of claim 2 wherein said second pair of tracks (24) are affixed to said carriage assembly (12) in a generally perpendicular plane, said perpendicular plane generally parallel to the plane of movement of said carriage.

4. The material handling vehicle of claim 3 wherein said first pair of tracks (22) is located adjacent the upper edges of said carriage assembly (12).

5. The material handling vehicle of claim 4 wherein said second pair of tracks (24) is located adjacent the lower edge of said carriage assembly (12).

6. The material handling vehicle of claim 1 further including horizontal power means (102) for selectively moving each of said forks (16,18).

7. The material handling vehicle as set forth in claim 6 further including vertical powering means (104) for moving said carriage assembly (12) vertically and further including relief means (122) for making each of said horizontal power means (102) responsive to pressure in said vertical power means (104).

8. The material handling vehicle of claim 6 wherein said horizontal power means (102) includes a first fluid motor (90) having one portion (94) affixed to said carriage assembly (12) and a second movable portion (100) affixed to one of said forks (18).

9. The material handling vehicle of claim 8 wherein said horizontal power means (102) includes a second fluid motor (92) having one portion (94') affixed to said carriage assembly (12) and a second movable portion (100') affixed to the other of said forks (16).

10. The material handling vehicle of claim 9 wherein the horizontal power means (102) includes a source of fluid pressure (106,108) and means (118,132,134) for selectively communicating fluid under pressure to one or the other said first (90) or said second (92) motors.

11. The material handling vehicle of claim 1 wherein each of said first (**22*a*) and second (22*b***) spaced apart tracks has an open end and a closed end, each of said sliding bars having an outer end portion, said outer end portion extending through said open end with said forks at the second position.

12. The carriage assembly of claim 11 wherein each of the first (26) and second (28) sliding bars has an inner end portion (**26*a*,28*a*) and each having a length (L) sufficient for maintaining said forks (16,18) substantially perpendicular relative to the track (22*a* or 22*b*) and said tracks (22*a* or 22*b*) being positioned one relative to the other at locations sufficient for the overlapping of the inner end portions (26*a*,28*a*) of the sliding bars at the first position of the forks (16,18**).

13. A carriage assembly (12) for a material handling vehicle (10) having a mast (14) comprising:

a carriage assembly (20) connectable to the mast (14) for vertical movement thereupon;

first (16) and second (18) load lifting forks each having a side;

track means (22,24) for movably connecting said forks (16,18) to said carriage (20) for movement of the forks (16,18) between a first position at which said respective sides of each fork (16,18) are in contact with one another and a second position at which said forks (16,18) are spaced one from the other, said track means (22,24) including a first (22) pair of tracks having first (**22*a*) and second (22*b*) spaced apart tracks each connected to the carriage assembly in a generally horizontal plane, said horizontal plane generally perpendicular to the vertical movement of the carriage assembly (12**);

said first (26) and second (28) sliding bars each being connected to a respective fork (16,18) and slidably connected to a respective track (**22*a* or 22*b*) so that with said respective sides of said forks (16,18) in contact with one another a portion of said sliding bars (26 and 28) are in an overlapping relation; and horizontal power means (102) for selectively moving each of said forks (16,18) along said track means (22,24**).

14. The carriage assembly (12) of claim 13 further including means (122) for making said horizontal power means responsive to a load imposed on said load lifting forks (16,18).

15. The carriage assembly of claim 14 wherein said power means (102) includes a first fluid motor (90) having one portion (94) affixed to said carriage (20) and a second movable portion (100) affixed to one of said forks (18).

16. The carriage assembly of claim 15 wherein said power means (102) includes a second fluid motor (92) having one portion (94') affixed to said carriage (20) and a second movable portion (100') affixed to the other of said forks (16).

* * * * *